US009366493B2

(12) United States Patent
Lupher

(10) Patent No.: US 9,366,493 B2
(45) Date of Patent: Jun. 14, 2016

(54) PRECISION GUIDED HANDGUN AND METHOD

(71) Applicant: TrackingPoint, Inc., Pflugerville, TX (US)

(72) Inventor: John Hancock Lupher, Austin, TX (US)

(73) Assignee: TrackingPoint, Inc., Pflugerville, TX (US)

( * ) Notice: Subject to any disclaimer, the term of this patent is extended or adjusted under 35 U.S.C. 154(b) by 157 days.

(21) Appl. No.: 14/150,646

(22) Filed: Jan. 8, 2014

(65) Prior Publication Data

US 2015/0253106 A1 Sep. 10, 2015

(51) Int. Cl.
*F41A 17/08* (2006.01)
*F41G 3/12* (2006.01)
*F41G 3/06* (2006.01)

(52) U.S. Cl.
CPC . *F41A 17/08* (2013.01); *F41G 3/12* (2013.01); *F41G 3/06* (2013.01)

(58) Field of Classification Search
CPC ..... H04N 5/23254; H04N 5/145; H04N 5/23258; H04N 5/23293; F41G 1/38; F41G 3/165; F41G 3/06; F41G 1/473; F41G 3/065; F41G 1/46; F41G 3/2627; F41G 3/2644; F41A 17/06; F41A 19/58
USPC ..... 42/111
See application file for complete search history.

(56) References Cited

U.S. PATENT DOCUMENTS 4,352,665 A * 10/1982 Kimble ..... F41A 33/02 434/22
6,301,371 B1 * 10/2001 Jones et al. ..... 382/106
8,907,288 B2 * 12/2014 Streuber et al. ..... 250/349
8,998,085 B2 * 4/2015 McHale et al. ..... 235/400
9,036,035 B2 * 5/2015 Lupher et al. ..... 348/208.6
9,057,583 B2 * 6/2015 Matthews ..... F41G 1/30
2004/0014010 A1 1/2004 Swensen et al.
2006/0050929 A1 * 3/2006 Rast ..... F41G 3/147 382/103
2012/0127271 A1 5/2012 Song
2013/0040268 A1 * 2/2013 Van der Walt et al. ..... 434/16
2013/0083024 A1 4/2013 Li et al.
2013/0286216 A1 * 10/2013 Lupher et al. ..... 348/169
2015/0101229 A1 * 4/2015 Hall ..... 42/69.01
2015/0108215 A1 * 4/2015 Ehrlich ..... G01S 17/88 235/404

FOREIGN PATENT DOCUMENTS

WO 2012121735 9/2012

OTHER PUBLICATIONS

"Bell Labs Invents Lensless Camera", Jun. 3, 2013, MIT Technology Review.*
International Search Report and Written Opinion, PCT/US2015/010663, Sep. 23, 2015, 7 pages.

* cited by examiner

*Primary Examiner* — Troy Chambers
*Assistant Examiner* — Joshua Semick
(74) *Attorney, Agent, or Firm* — Cesari & Reed LLP; R. Michael Reed

(57) ABSTRACT

A precision guided handgun includes a handgun and includes a sensor circuit coupled to the handgun and configured to capture optical data associated with a view area. The precision guided handgun further includes a controller coupled to the handgun and configured to process the optical data to detect a foreground object within the optical data. The controller automatically selects the foreground object as a target.

19 Claims, 4 Drawing Sheets

PRECISION GUIDED HANDGUN AND METHOD

FIELD

The present disclosure is generally related to small arms firearms, including pistols, rifles, shotguns, and other handguns, and more particularly to firearms with a controller configured to selectively enable discharge of the firearm when its aim point is aligned to a target.

BACKGROUND

Small arms firearms, including handguns (such as pistols), rifles, and shotguns are small profile firearms that are designed to be held in a shooter's hands and to be discharged toward a target. Unfortunately, it can be difficult to correctly aim such firearms toward a target, particularly under pressure, due to human jitter.

One technique for improving shooting accuracy involves mounting a laser site onto the firearm. Laser sights are particularly effective as sighting devices because the lasers illuminate spots on their targets and do not require users to align an eye with a sighting device. When mounted on a firearm and activated, the laser sight emits a beams toward the aim point of the handgun, placing a visible dot or mark on a target approximating the aim point of the firearm. However, holding on target while pulling the trigger is still challenging and is a common reason for missing the target, especially when under pressure.

SUMMARY

In an embodiment, a precision guided handgun includes a handgun and includes a sensor circuit coupled to the handgun and configured to capture optical data associated with a view area. The precision guided handgun further includes a controller coupled to the handgun and configured to process the optical data to detect a foreground object within the optical data. The controller automatically selects the foreground object as a target.

In another embodiment, a method of providing a precision guided firearm includes receiving optical data associated with a view area at a circuit of a firearm from a sensor. The method further includes processing the optical data to determine a range to a foreground object within the view area using the circuit and automatically selecting the foreground object as a target.

In still another embodiment, a firearm includes a barrel, a grip, and a trigger assembly. The firearm further includes a sensor circuit configured to capture optical data associated with a view area, and includes a controller configured to process the optical data to automatically acquire a target within the view area.

BRIEF DESCRIPTION OF THE DRAWINGS

In the following discussion, the same reference numbers are used in the various embodiments to indicate the same or similar elements.

DETAILED DESCRIPTION OF ILLUSTRATIVE EMBODIMENTS

Embodiments of a precision guided handgun include a controller coupled to a sensor and to a trigger assembly. The controller is configured to receive optical data corresponding to a view area of a sensor and to process the optical data to detect a target within the view area. In an embodiment, the controller processes optical data from two different views of the view area to select a foreground object as a target based on the parallax. In another embodiment, the controller may utilize an optical ranging circuit to illuminate a view area and to receive the optical data in response thereto. The optical data may be used to select a foreground object as the target.

In an embodiment, the controller may be coupled to one or more orientation sensors and/or motion sensors and may be configured to determine an aim point of the firearm based on such data. The controller may be further configured to control the trigger assembly to selectively enable discharge of the handgun when the aim point of the handgun corresponds to a location on the target. An embodiment of a precision guided handgun is described below with respect to FIG. 1.

Figure 1:
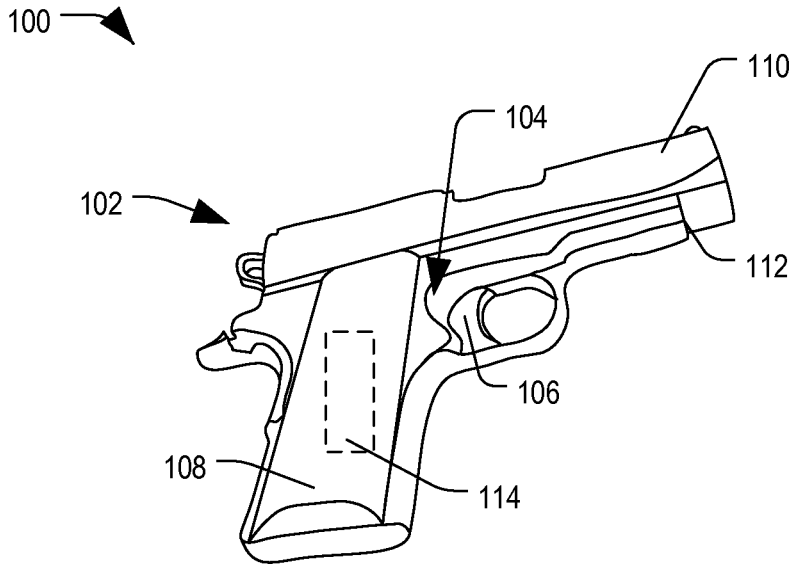
FIG. 1 is a perspective view of a precision guided handgun according to an embodiment.

FIG. 1 is a perspective view of a precision guided firearm (PGF) implemented as a precision guided handgun (PGH) 100 according to an embodiment. PGH 100 includes a handgun 102 having a trigger assembly 104 with a trigger shoe 106. The handgun 102 further includes a grip 108 and a barrel 110. PGH 100 further includes a sensor 112 mounted to the barrel 110 and configured to capture optical data associated with a field of view of the sensor 112. The sensor 112 is communicatively coupled to a circuit 114 that is contained within or integrated into the grip 108. In one embodiment, the circuit 114 may be mounted within an enclosure defined within the grip 108. In another embodiment, the circuit 114 may be integrated into a casing that is attached to the handgun 102. The circuit 114 may also be coupled to the trigger assembly 104 through a wired communications link (not shown).

In an embodiment, the circuit 114 may include a battery or other power source, which may deliver power to the circuit 114 as well as to the sensor 112 and the trigger assembly 104. Trigger assembly 104 may include a solenoid or other circuit that is responsive to control signals from circuit 114 to control timing of the discharge of the handgun 102, for example, by selectively enabling or disabling the solenoid to prevent or allow movement of the trigger shoe to release the hammer, bolt, or other discharge mechanism. Alternatively, the circuit 114 may include an electronic trigger assembly configured to be responsive to a signal from a controller to discharge of the handgun 102.

In an embodiment, the circuit 114 further includes a controller and includes one or more motion sensors, such as an accelerometer, a gyroscope, an inclinometer, an attitude sensor, and so on, which may provide motion data/orientation data to the controller. The controller is configured to determine an aim point of the handgun 102 and to process the optical data associated with the view area that is received from the sensor 112 and to automatically acquire a target within the view area. Depending on the type of data, automatic target acquisition may be achieved in a variety of ways.

In an embodiment, the controller may detect movement of the trigger shoe 106 indicating a trigger pull event. The trigger pull event may correspond to a movement of the trigger shoe 106 that exceeds a predetermined distance threshold. In response to detecting the trigger pull event, the controller may automatically acquire a target within a field of view of sensor 112, and may also determine an aim point of the handgun 102 based, at least in part, on the motion/orientation data. In some embodiments, the controller may determine a target based on a combination of the motion/orientation data and the optical data associated with the view area. The controller may selectively enable discharge of the handgun 102 when the aim point of the handgun corresponds to the location of the target within the view area of the sensor 112.

In an example, the sensor 112 may be a camera, which may capture image information (or optical data) corresponding to the field of view over a period of time, which image information may be processed by the controller to detect an object within the view area. In a particular example, the camera may be a single pixel camera. In another example, the camera may be a low-resolution camera configured to capture course image information (or optical data) corresponding to the field of view. In one possible embodiment, the controller may detect movement from one image sample to another and may select a foreground object based on the relative motion. In another embodiment or in addition to the motion-based foreground object detection, the controller may utilize object detection algorithms, boundary detection, other techniques, or any combination thereof to detect boundaries of the foreground object and/or to detect boundaries of the moving object to acquire the object as a target.

In an embodiment, the sensor 112 may be a thermal sensor that may be adapted to detect thermal radiation within a field of view and to provide data related to the detected thermal radiation to the controller. In a particular example, the thermal sensor may be implemented a single pixel thermal camera configured to capture optical data corresponding to thermal characteristics of an object within the view area. The controller may process the thermal data using blob detection algorithms, boundary detection, other techniques, or any combination thereof to automatically acquire a target.

In another embodiment, the sensor 112 may be a flash light detection and ranging (flash LIDAR) circuit configured to illuminate an object with a beam within a field of view and to receive reflected energy, which can be used to range an object as well as to provide course shape information based on a sequence of samples. The course shape data may be used to identify a foreground object that can be automatically selected as a target. In still another embodiment, the sensor 112 may be part of an optical ranging circuit, such as a laser ranging circuit, a parallax ranging circuit or other circuit configured to determine a distance between the handgun 102 and a foreground object based on the optical data.

In yet another embodiment, the sensor 112 may be an ultrasonic circuit configured to transmit an ultrasonic signal toward a field of view and to receive reflected signals, which may be used to detect foreground and background objects. The controller may determine a foreground object within the view area based on the reflected signals and may automatically select the foreground object as the target.

In still another embodiment, sensor 112 may be implemented as a pair of cameras mounted to the barrel and spaced apart by a known distance to provide a camera parallax implementation where foreground objects may be displaced relative to one another in the two camera images. In an embodiment, the cameras (or image sensors) may be mounted to opposing sides of the barrel. In an embodiment, the controller may automatically acquire a target by determining the closest object from the overlapping camera images and by selecting a center of the detected foreground object as the target. Alternatively, the sensor 112 may be implemented to capture two different fields of view of the view area through two apertures spaced apart by a known distance. In an embodiment, the controller may detect a foreground object within a view area based on an optical measurement of parallax.

Once a target is acquired within the field of view, the controller may control the trigger assembly 104 to selectively enable discharge of the handgun 102. In an example, the controller may selectively enable discharge of the handgun 102 when the aim point of the handgun 102 corresponds to the position of the target within the view area. If the shooter is pulling the trigger shoe 106 but the aim point is not aligned to the target, the controller may send a control signal to the trigger assembly 104 to prevent or enable discharge of the handgun 102. Alternatively the controller may withhold a control signal so that the trigger assembly is not enabled. Thus, the handgun 102 becomes a PGH 100, selectively enabling discharge of the handgun 102 when the aim point of the handgun 102 as aligned such that the bullet will hit the target when discharged.

It should be understood that, in the illustrated example of FIG. 1, sensor 112 is integrated into a bottom portion of the barrel 110. In an alternative embodiment, the sensor 112 may be integrated into an upper portion of the barrel 110, along one or both sides of the barrel 110, on the bottom of the barrel 110, or any combination thereof. Alternatively, the sensor 112 may be integrated into a trigger guard. Further, though the illustrated example of FIG. 1 is directed to a handgun implementation, in alternative embodiments, the firearm may be a rifle, a shotgun or other type of hand-held firearm. An example of a PGH that includes a trigger assembly 104, a sensor 112 mounted to the outside of the barrel 110, and a control circuit within the grip 108 is described below with respect to FIG. 2.

Figure 2:
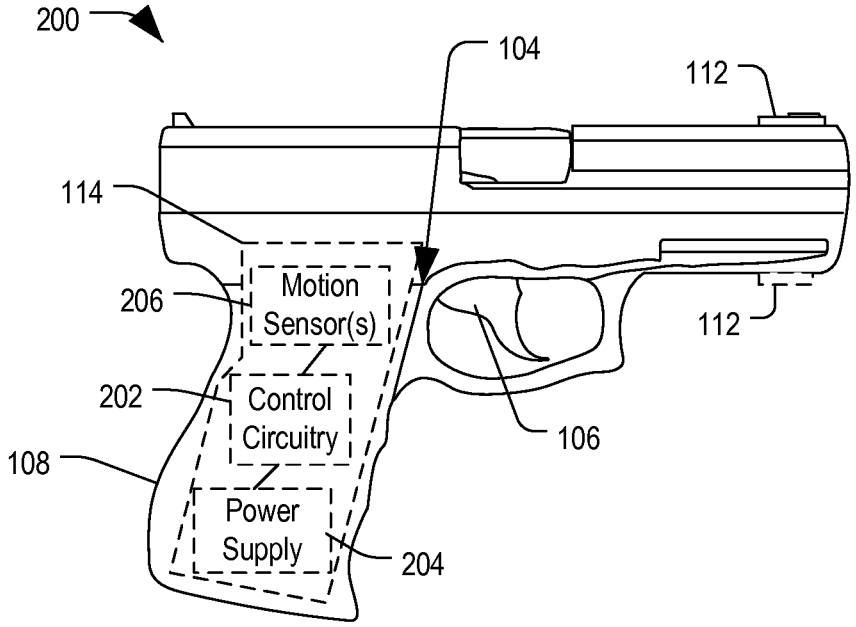
FIG. 2 is a side-view of a precision guided handgun according to an embodiment.

FIG. 2 is a side-view of a PGH 200 according to an embodiment. PGH 200 includes handgun 102 that includes a trigger assembly 104 including a trigger shoe 106. Handgun 102 further includes a grip 108 and a barrel 110. In this example, the sensor 112 may include one or more optical sensors that may be mounted to the top of barrel 110 as part of the iron site, within the iron site, or adjacent to the iron site. Alternatively or in addition, the sensor 112 may include an optical sensor that may be mounted to the underside of the barrel 110. In an alternative embodiment, sensors 112 may be mounted on either side of barrel 110.

In the illustrated example, the circuit 114 may be situated within the grip 108. In this example, the circuit 114 includes control circuitry 202 that is coupled to the sensor(s) 112 and to trigger assembly 104. The control circuitry 202 may include the controller and other circuitry. The circuit 114 includes a power supply 204 and one or more motion sensors (or orientation sensors) 206 that are coupled to the control circuitry 202. The controller circuitry 202 may be configured to process data from the sensor(s) 112 to acquire a target, to process data from the one or more motion sensors 206 to determine an aim point of the handgun 102, and to selectively enable discharge of the handgun 102 when the aim point of the handgun is aligned to the target.

While the illustrated examples of FIGS. 1 and 2 have depicted particular types of handguns, it should be appreciated that the control circuitry 202 may be configured to automatically select a target for handguns and/or for other types of firearms, such as airsoft guns, pellet guns, rifles, shotguns, snub-nosed shotguns, and other types of hand-held firearms.

Further, in an embodiment, the circuit 114 may include an interface (such as a Universal Serial Bus (USB) interface) or a wireless transceiver to allow a user to couple to a computing device, such as a smart phone, a portable computer, a tablet computer, or other computing device, and to configure settings, such as threshold error. The interface may be accessible by removing or opening a cover of the interface port or by detaching a portion of the grip 108. In an example, the user may interact with the computing device to configure a threshold error defining a distance between an aim point of the handgun 102 and a location on the selected target. When the trigger is pulled, the controller may determine a difference between the center of the target and the aim point and may selectively enable discharge of the handgun 102 when the distance between the aim point and the center of the target is less than the threshold error. In an example, the center of the target may be determined from the sensor data such as based on a midpoint of the detected boundaries of the foreground object.

Figure 3:
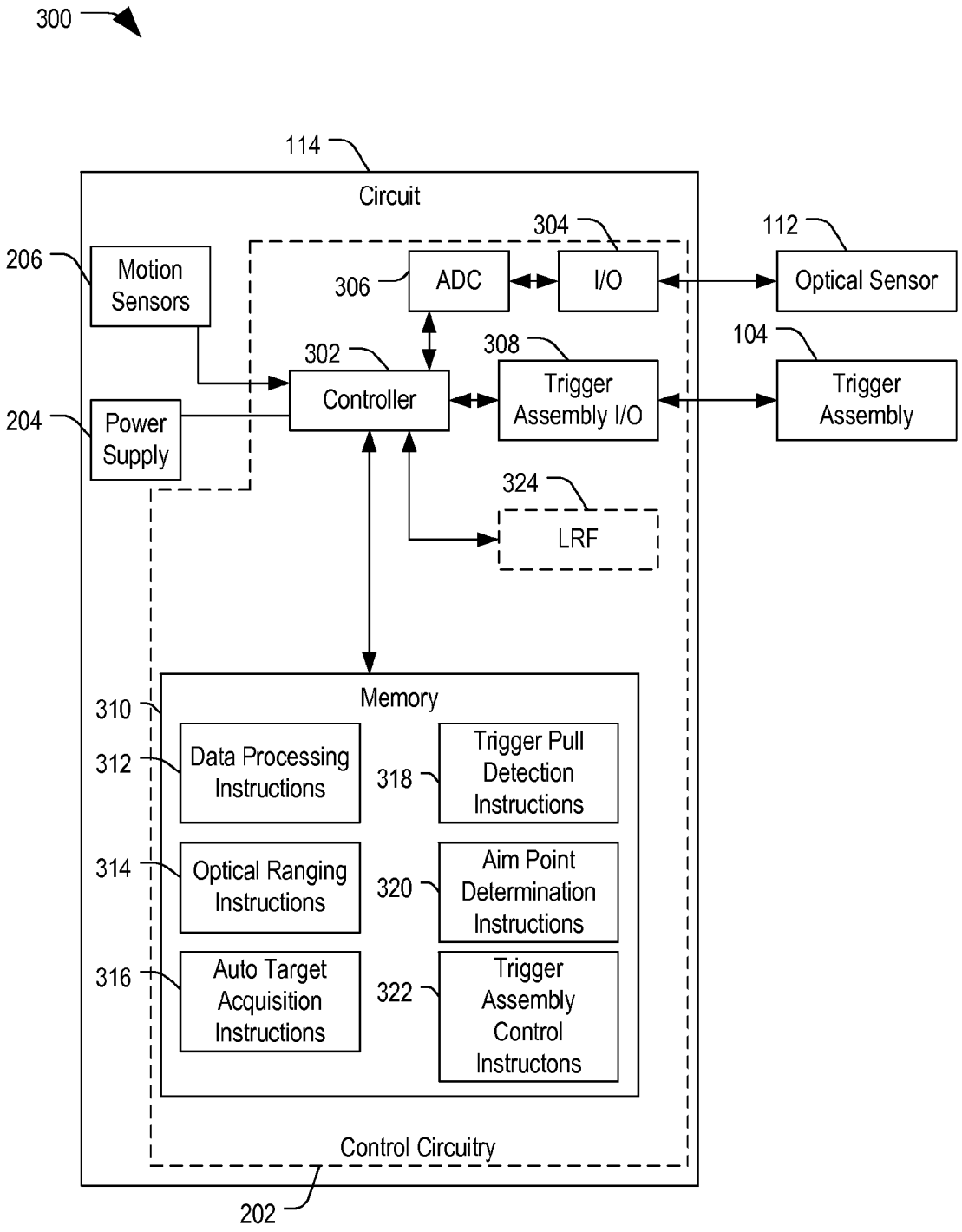
FIG. 3 is a block diagram of a control system that may be mounted to or integrated with a firearm to provide a precision guided handgun according to an embodiment.

FIG. 3 is a block diagram of a control system 300 that may be mounted to or integrated with a firearm to provide a PGF according to an embodiment. The control system 300 includes the circuit 114, the sensor 112, and the trigger assembly 104. The circuit 114 further includes the control circuitry 202, the power supply 204 (which may be a battery), and the motion sensors 206.

The control circuitry 202 includes a controller 302 coupled to sensor 112 through an input/output (I/O) interface 304 and an analog-to-digital converter (ADC) 306. In an embodiment, the ADC 306 may be integrated within the sensor 112 or into the I/O interface 304. The control circuitry 202 further includes a trigger assembly I/O interface 308, which is coupled to the controller 302 and to the trigger assembly 104. The control circuitry 202 also includes a memory 310 that is coupled to the controller 302. The motion sensors 206 and the power supply 204 are also coupled to the controller 302. As discussed above, the controller 302 may operate as a power management unit configured to distribute power to the memory 310, the ADC 306, the I/O interface 304, the trigger assembly I/O interface 308, the motion sensors 206, and even to the sensor 112 and the trigger assembly 104. In an embodiment, the controller 302 may include a processor, a microcontroller unit (MCU), a field programmable gate array (FPGA) or any combination thereof.

The memory 310 is a non-volatile memory configured to store thresholds and/or to store instructions that, when executed, cause the controller 302 to perform a variety of functions. The memory 310 includes data processing instructions 312 that, when executed, cause the controller 302 to process data received from the sensor 112. The data may be image data, thermal data, ultrasonic data, light detection and ranging data, other data associated with the view area of the sensor 112, or any combination thereof. In a particular example, the sensor 112 may include multiple sensors configured to capture different types of data. In one example, the data processing instructions 312 may cause the controller 302 to assemble multiple single-pixel samples of a field of view to provide an image, a thermal snapshot, or three-dimensional representation of the field of view for further processing.

The memory 310 further includes optical ranging instructions 314 that, when executed, cause the controller 302 to detect one or more objects within the optical data of the field of view. In some examples, the optical ranging instructions 314 cause the controller 302 to detect regions in a set of digital data that differ in properties, such as brightness or color (image data) or intensity (thermal or acoustic data), as compared to areas surrounding those regions. In one example, the optical ranging instructions 314 cause the controller 302 to identify one or more regions within a field of view of the sensor 112 in which some properties are constant or vary within a prescribed range of values, representing a foreground shape or foreground object within the field of view. As used herein, the term "field of view" refers to an area that is sensed by the sensor, whether the sensor is acoustic, optical, thermal, or another type of directional sensor. In one example, the optical ranging instructions 314 cause the controller 302 to utilize differential methods, which are based on derivatives of a data processing function with respect to position. In another example, the optical ranging instructions 314 cause the controller 302 to utilize methods based on local extreme, which are based on finding the local maxima and minima of the data processing function. In an example, the controller 302 may utilize the optical ranging instructions 314 to detect boundaries of an object in the foreground or background of the field of view.

The memory 310 may also include auto target acquisition instructions 316 that, when executed, cause the controller 302 to automatically acquire a target based on one or more foreground objects within the data representing the field of view. In one example, the target acquisition instructions 316 cause the controller 302 to acquire a target based on movement of one of the foreground objects within the field of view over a period of time. In another example, the target acquisition instructions 316 cause the controller 302 to acquire a target by selecting a nearest foreground object. In still another example, the target acquisition instructions 316 cause the controller 302 to acquire a target by selecting a curved shape from among one or more foreground objects. The target acquisition instructions 316 may be configured to acquire a target object in a variety of ways, depending on the particular implementation and/or intended usage for the firearm. Additionally, target acquisition instructions 316 may cause the controller 302 to select the target from among multiple foreground objects based on aim point information from the one or more motion sensors 206.

The memory 318 further includes trigger pull detection instructions 318 that, when executed, cause the controller 302 to detect a trigger pull event based on movement of the trigger shoe 106 coupled to the trigger assembly 104. In an example, the trigger assembly 104 may include one or more sensors, such as an optical sensor, a Hall effect sensor, an electrical switch, or any combination thereof that can be used to detect movement of the trigger shoe 106 and to communicate a signal indicating movement of the trigger shoe 106 to controller 302 through trigger assembly I/O interface 308.

The memory 318 also includes aim point determination instructions 320 that, when executed, cause the controller 302 to process motion data from the one or more motion sensors 206, which may include one or more accelerometers, one or more gyroscopes, one or more inclinometers, and one or more other sensors. Aim point determination instructions 320, when executed, may cause the controller 302 to determine an orientation of the firearm relative to the field of view of the sensor 112. In an example, the controller 302 may process the motion data in conjunction with data from the sensor 112 to determine the aim point of the firearm, such as handgun 102.

The memory 310 also includes trigger assembly control instructions 322 that, when executed, cause the controller 302 to selectively enable discharge of the firearm when the aim point of the firearm is aligned to the target within the field of view. In an embodiment, the controller 302 may selectively enable discharge when the aim point is within a threshold distance of a center of the target. The controller 302 may selectively enable discharge by providing a control signal to a solenoid of the trigger assembly 104, where the solenoid is configured to block or otherwise selectively enable discharge of the firearm. The controller 302 may permit discharge by terminating the signal. In another embodiment, the controller may selectively enable discharge by providing a signal to the trigger assembly 104 only when the aim point is aligned to the target.

In an embodiment, the controller 302 executes the trigger pull detection instructions 318 until a trigger pull event is detected. Once a trigger pull event is detected, the controller 302 may execute the trigger assembly control instructions 322 to selectively enable discharge of the firearm until other conditions are met. In conjunction with or simultaneous with the execution of the trigger assembly control instructions 322, the controller 302 may execute the image processing instructions 312 to capture data from the sensor 112 and to process and assemble the data. The controller 302 may also execute the optical ranging instructions 314 to identify one or more foreground objects within the data from the field of view and may execute the auto target acquisition instructions 316 to automatically select a target from the objects within the field of view. The controller 302 may then determine the aim point of the firearm using the aim point determination instructions 320 and may control the timing of discharge of the handgun 102 to selectively enable discharge when the aim point is aligned to the target.

In an embodiment, circuit 114 may include a laser range finder circuit 324, which may be enabled by the controller 302 based on execution of the optical ranging instructions 314. Laser range finder circuit 324 may determine ranges for objects within the view area, detecting one or more foreground objects during the process. In some embodiments, sensor(s) 112 may receive the reflected laser light, and controller 302 may determine the foreground object from the range information to automatically acquire the target.

Figure 4:
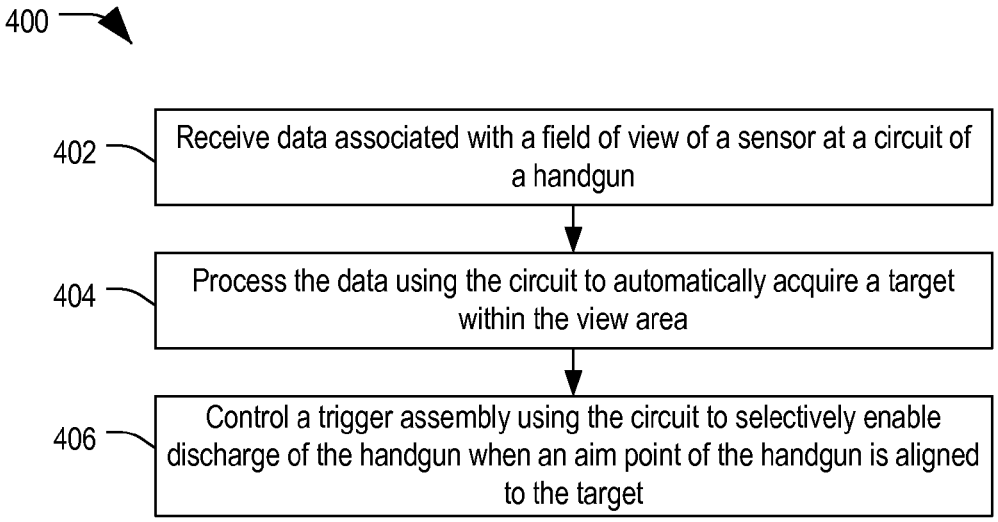
FIG. 4 is a flow diagram of a method of automatically acquiring a target to provide a precision guided handgun according to an embodiment.

FIG. 4 is a flow diagram of a method 400 of automatically acquiring a target to provide a PGH according to an embodiment. The method 400 includes receiving data associated with a field of view of a sensor at a circuit of a handgun, at 402. In an embodiment, the data is received after detection of a trigger pull event. As discussed above, the sensor may be a single pixel camera, a thermal sensor, a light detection and ranging circuit, a range finder, an ultrasonic sensor, another type of sensor, or any combination thereof. Advancing to 404, the data is processed using the circuit to automatically acquire a target within the view area. The target may be acquired by selecting a foreground object, based on movement, based on a pre-determined type of shape, and/or based on other factors. In an embodiment, the circuit may detect multiple foreground objects. In one example, the circuit may select a closest foreground object as the target. In another example, the circuit may utilize aim point data from motion sensors 206 to determine the user's attempted aim point and may select a foreground object that corresponds to a centroid of an aim path. In an embodiment, the data is processed in response to detecting a trigger pull event, and, in the absence of a trigger pull, data from the sensor 112 may be ignored.

Continuing to 406, the circuit controls a trigger assembly to selectively enable discharge of the handgun when an aim point of the handgun is aligned to the target. The circuit may provide a control signal to a solenoid to block movement of a trigger shoe 106 and/or may send an enable signal to enable discharge, depending on the implementation. In another embodiment, the circuit may control timing of the discharge of the handgun 102 such that the handgun 102 is allowed to discharge when the aim path is projected to align with the selected target.

In an embodiment, the method may further include receiving motion data associated with the handgun at the circuit from one or more motion sensors, such as a gyroscope, an accelerometer, an inclinometer, other sensors, or any combination thereof. The method may further include determining the aim point of the firearm based on the motion data. In an example described below with respect to FIG. 5, the controller may determine a distance between the aim point and a selected location on a target (such as a center of the target object), and may selectively enable discharge when the distance is less than a threshold distance.

Figure 5:
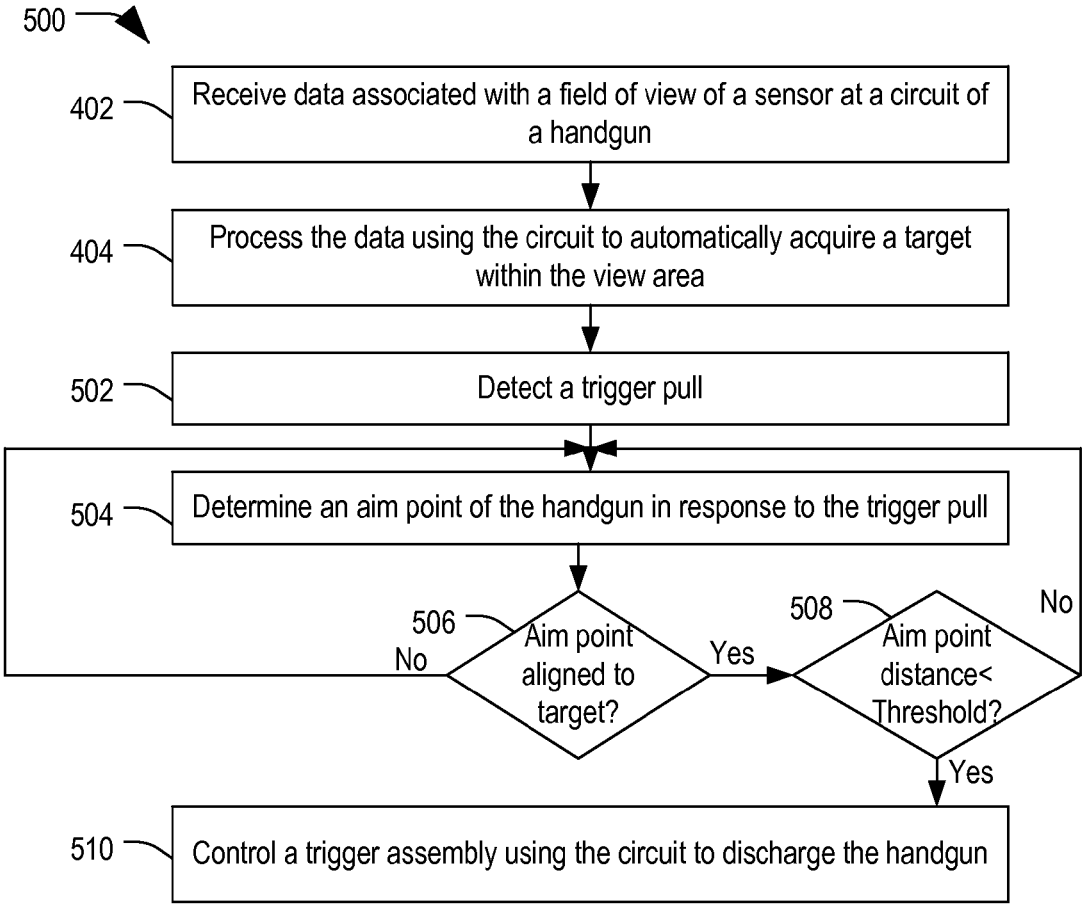
FIG. 5 is a flow diagram of a method of automatically acquiring a target to provide a precision guided handgun according to a second embodiment.

FIG. 5 is a flow diagram of a method 500 of automatically acquiring a target to provide a PGH according to a second embodiment. The method 500 may begin with the same steps as the method 400 of FIG. 4. The method 500 includes receiving data associated with a field of view of a sensor at a circuit of a handgun, at 402. Advancing to 404, the data is processed using the circuit to automatically acquire a target within the view area.

Moving to 502, the controller detects a trigger pull. In one example, the trigger assembly includes one or more sensors configured to communicate a signal to the controller in response to movement of the trigger shoe. Proceeding to 504, the controller determines an aim point of the handgun in response to the trigger pull. As discussed above, the controller may receive motion data from one or more motion sensors and may determine an aim point relative to the field of view of the sensor in response to the motion data and optionally in response to the data from the sensor 112. In an example, the controller may determine an average of the motion data to determine a center location corresponding to the target. In another example, the controller may determine the target based on parallax camera images, an optical measurement of parallax, an optical range finder such as a light detection and ranging (LiDAR) circuit, or other image data to select an aim point corresponding to a center of a foreground object.

Advancing to 506, the controller determines if the aim point is aligned to the target. If not, the method 500 returns to 504 and the controller determines the aim point of the handgun. If the aim point is aligned to the target at 506, the method 500 advances to 508 and the controller determines if the distance between the aim point and a selected location on the target is less than a threshold. If not, the method 500 returns to 504 and the controller determines the aim point of the handgun. Otherwise, the method 500 continues to 510, and the controller controls the trigger assembly to discharge the handgun. In an example, the controller may send a signal to the trigger assembly causing the trigger assembly to discharge the handgun. In another example, the controller may send a signal to the trigger assembly to selectively enable the trigger assembly to permit discharge.

It should be noted that the particular arrangement of blocks in the method of FIG. 5 may be altered without departing from the teachings of the present disclosure. For example, block 502 may be provided prior to or just after block 402. In one example, the sensor 112 is activated by the controller 302 in response to detection of a trigger pull. Similarly, the determination of the aim point may be made in response to detection of the trigger pull. Other steps may also be added without departing from the spirit of the disclosure.

Figure 6:
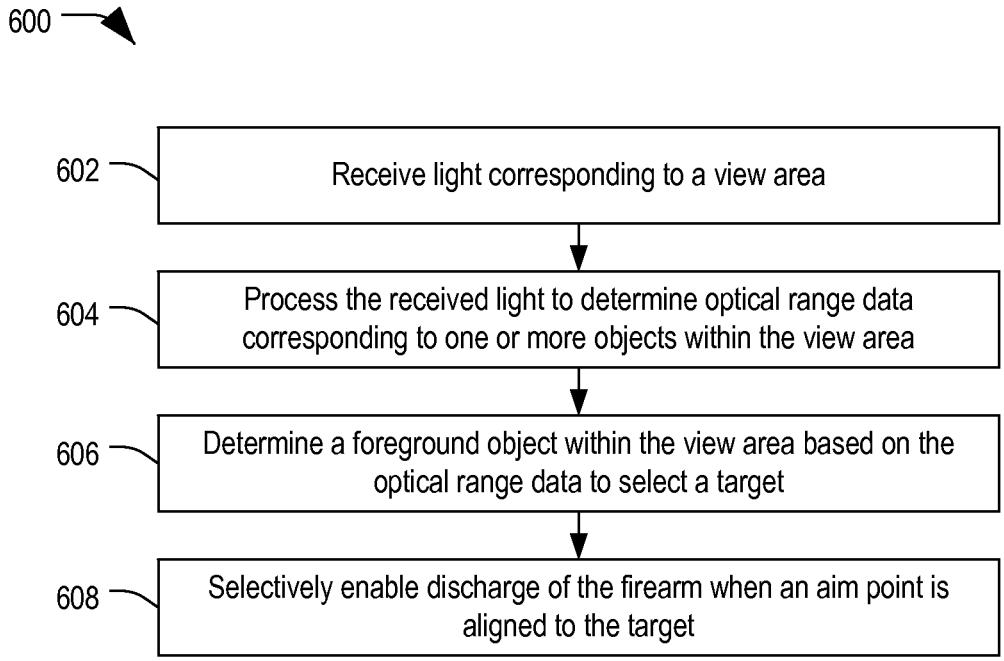
FIG. 6 is a flow diagram of a method of method of automatically acquiring a target to provide a precision guided handgun according to a third embodiment.

FIG. 6 is a flow diagram of a method 600 of method of automatically acquiring a target to provide a precision guided handgun according to a third embodiment. At 602, light is received that corresponds to a view area. The light may be reflected by an object in the view area or may include image data corresponding to the view area.

Advancing to 604, the received light is processed to determine optical range data corresponding to one or more objects within the view area. The optical range data may be determined from two images of different views of the view area. Alternatively, the optical range data may be determined by a laser range finding operation or other optical range finding or measurement of parallax. Continuing to 606, the controller determines a foreground object within the view area based on the optical range data to select a target. Proceeding to 608, the controller may selectively enable discharge of the firearm when an aim point is aligned to the target.

In conjunction with the circuits, systems, and methods described above with respect to FIGS. 1-6, a precision guided handgun is described that includes a sensor and a controller coupled to the sensor. The controller is configured to automatically acquire a target in a field of view of the sensor based on the sensor data and optionally to control timing of the discharge of the handgun when the aim point is aligned to the target.

Although the present disclosure has been described with reference to preferred embodiments, workers skilled in the art will recognize that changes may be made in form and detail without departing from the scope of the disclosure.

What is claimed is:

1. A precision guided handgun comprising:

a handgun;

a sensor circuit coupled to the handgun and configured to capture optical data including a first and second optical data associated with a view area, the sensor circuit including a first optical sensor to capture the first optical data and a second optical sensor to capture the second optical data, the first and second optical sensors spaced apart by a pre-determined distance and configured to capture first and second optical data corresponding to different views of the view area; and a controller coupled to the handgun and configured to process the optical data to detect a foreground object within the optical data based on an optical measurement of parallax from the first optical data and the second optical data, the controller to automatically select the foreground object as a target.

2. The precision guided handgun of claim 1, wherein:

the handgun further comprises a barrel; and the sensor circuit includes one or more optical sensors mounted to the barrel.

3. The precision guided handgun of claim 1, wherein:

the handgun includes an iron site and a trigger guard; and the sensor circuit includes an optical sensor integrated within one of the iron site and the trigger guard.

4. The precision guided handgun of claim 1, wherein:

the sensor circuit comprises a camera; and the controller uses the optical data from the camera to determine a range to the foreground object.

5. The precision guided handgun of claim 1, wherein the sensor circuit comprises a single camera configured to capture the optical data from two different fields of view.

6. The precision guided handgun of claim 1, wherein the sensor circuit comprises a thermal sensor to capture the optical data corresponding to a thermal representation of a foreground object within a view area of the thermal sensor.

7. The precision guided handgun of claim 1, wherein the sensor circuit includes an optical range finding circuit to determine the foreground object from the optical data.

8. A method of providing a precision guided firearm, the method comprising:

receiving optical data associated with a view area at a circuit of a firearm from a sensor;

processing the optical data to determine a foreground object based on an optical measurement of parallax and to determine a range to a foreground object within the view area using the circuit; and automatically selecting the foreground object as a target.

9. The method of claim 8, wherein receiving the optical data comprises receiving optical data corresponding to two different fields of view.

10. The method of claim 9, further comprising:

capturing the optical data from a first field of view and from a second field of view at the sensor; and providing the optical data corresponding to the first and second fields of view to the circuit.

11. A firearm comprising:

a barrel;

a grip;

a trigger assembly;

a sensor circuit configured to capture optical data associated with a view area;

wherein the sensor circuit comprises a first optical sensor coupled to the barrel and configured to capture first optical data associated with the field of view; and a second optical sensor coupled to the barrel and separated from the first optical sensor by a distance, the second optical sensor configured to capture second optical data associated with the field of view; and a controller configured to process the optical data to determine a foreground object based on at least one of a plurality of range data from the optical data and an optical measurement of parallax and to automatically select the foreground object as a target within the view area.

12. The firearm of claim 11, wherein the sensor circuit comprises at least one single pixel camera.

13. The firearm of claim 11, further comprising the sensor circuit to capture two fields of view of the view area.

14. The firearm of claim 11, wherein the controller is coupled to the first optical sensor and the second optical sensor, the controller configured to determine the foreground object based on the optical measurement of parallax determined from the first optical data and the second optical data and to select the foreground object as the target.

15. The firearm of claim 11, further comprising the controller to determine a range to a foreground object within the view area based on the optical data.

16. The firearm of claim 11, wherein the sensor circuit comprises an optical sensor coupled to one of an iron site and a trigger guard of the firearm.

17. The firearm of claim 11, further comprising:

one or more sensors configured to provide orientation data to the controller; and wherein the controller determines an aim point of the barrel based on the orientation data.

18. The firearm of claim 17, wherein the controller enables the trigger assembly to discharge the precision guided firearm when the aim point is within a threshold distance of a center of the target.

19. The firearm of claim 11, wherein:

the sensor circuit comprises a laser ranging circuit configured to generate the plurality of range data; and the controller determines the foreground object based on the plurality of range data.

* * * * *